US007429186B2

(12) United States Patent
Mrakovich et al.

(10) Patent No.: US 7,429,186 B2
(45) Date of Patent: Sep. 30, 2008

(54) FLEXIBLE HIGH-POWER LED LIGHTING SYSTEM

(75) Inventors: Matthew Mrakovich, Streetsborough, OH (US); Jeffrey Nall, Brecksville, OH (US)

(73) Assignee: Lumination LLC, Valley View, OH (US)

( * ) Notice: Subject to any disclaimer, the term of this patent is extended or adjusted under 35 U.S.C. 154(b) by 86 days.

(21) Appl. No.: 10/819,328

(22) Filed: Apr. 6, 2004

(65) Prior Publication Data

US 2005/0221659 A1 Oct. 6, 2005

(51) Int. Cl.
*H01R 4/24* (2006.01)

(52) U.S. Cl. ..... 439/404

(58) Field of Classification Search ..... 439/404, 439/403, 417; 362/294, 559, 373, 545, 549; 257/E33.7

See application file for complete search history.

(56) References Cited

U.S. PATENT DOCUMENTS

| | | | |
|---|---|---|---|
| 671,338 | A | 4/1901 | Halford |
| 3,115,541 | A | 12/1963 | Hanner et al. |
| 4,173,035 | A | 10/1979 | Hoyt |
| 4,419,538 | A | 12/1983 | Hansell, III |
| 4,631,650 | A | 12/1986 | Ahroni |
| 4,638,117 | A | 1/1987 | Ney |
| 4,701,991 | A | 10/1987 | Scheffer, Sr. |
| 4,729,076 | A | 3/1988 | Masami et al. |
| 4,777,573 | A | 10/1988 | Liao |
| 4,779,177 | A | 10/1988 | Ahroni |
| 4,807,098 | A | 2/1989 | Ahroni |
| 4,813,883 | A | 3/1989 | Staley |
| 4,815,814 | A | 3/1989 | Ulijasz |
| 4,855,882 | A | 8/1989 | Boss |
| 4,855,885 | A | 8/1989 | Mac Eachern et al. |
| 4,899,266 | A | 2/1990 | Ahroni |
| 4,908,743 | A | 3/1990 | Miller |
| 4,984,999 | A | 1/1991 | Leake |
| 5,010,463 | A | 4/1991 | Ross |
| 5,051,877 | A | 9/1991 | Liao |
| 5,109,324 | A | 4/1992 | Ahroni |
| 5,121,310 | A | 6/1992 | Ahroni |
| 5,141,449 | A | 8/1992 | Tieszen |
| 5,154,508 | A | 10/1992 | Ahroni |
| 5,173,839 | A | 12/1992 | Metz, Jr. |

(Continued)

FOREIGN PATENT DOCUMENTS

| | | | |
|---|---|---|---|
| CH | 673 349 | A5 | 2/1990 |

(Continued)

OTHER PUBLICATIONS

International Search Report dated Dec. 13, 2007.

(Continued)

*Primary Examiner*—Alexander Gilman
(74) *Attorney, Agent, or Firm*—Fay Sharpe LLP

(57) ABSTRACT

An LED light engine includes a flexible electrical cable, a wire-socket assembly attached to the cable, and an LED module selectively attached to the wire-socket assembly. The wire-socket assembly includes at least two IDC terminals. The IDC terminal displaces the insulating covering of the cable and contacts one of the electrical conductors. The LED module includes an LED electrically connected to the IDC terminals when the LED module attaches to the wire-socket assembly.

21 Claims, 6 Drawing Sheets

U.S. PATENT DOCUMENTS

| | | | | |
|---|---|---|---|---|
| 5,238,424 | A | 8/1993 | Vindum | |
| 5,257,049 | A * | 10/1993 | Van Peteghem | 347/238 |
| 5,278,432 | A | 1/1994 | Ignatius et al. | |
| 5,330,368 | A | 7/1994 | Tsuruzono | |
| 5,337,225 | A | 8/1994 | Brookman | |
| 5,367,122 | A | 11/1994 | De Olano | |
| 5,526,250 | A | 6/1996 | Ting et al. | |
| 5,528,474 | A | 6/1996 | Roney et al. | |
| 5,559,681 | A | 9/1996 | Duarte | |
| 5,584,567 | A | 12/1996 | Rumpel | |
| 5,601,448 | A | 2/1997 | Poon | |
| 5,672,000 | A | 9/1997 | Lin | |
| 5,697,175 | A | 12/1997 | Schwartz | |
| 5,785,418 | A | 7/1998 | Hochstein | |
| 5,829,865 | A | 11/1998 | Ahroni | |
| 5,848,837 | A | 12/1998 | Gustafson | |
| 5,857,767 | A | 1/1999 | Hochstein | |
| 5,934,930 | A | 8/1999 | Camps et al. | |
| 5,967,823 | A | 10/1999 | Tsui | |
| 6,017,241 | A | 1/2000 | Komai | |
| 6,042,248 | A | 3/2000 | Hannah et al. | |
| 6,079,848 | A | 6/2000 | Ahroni | |
| 6,095,847 | A | 8/2000 | Lin | |
| 6,116,944 | A | 9/2000 | Tseng | |
| 6,167,740 | B1 | 1/2001 | Lipari et al. | |
| 6,249,267 | B1 | 6/2001 | Ishihara | |
| 6,261,119 | B1 * | 7/2001 | Green | 439/425 |
| 6,274,924 | B1 | 8/2001 | Carey et al. | |
| 6,283,612 | B1 | 9/2001 | Hunter | |
| 6,290,365 | B1 | 9/2001 | Schlesinger | |
| 6,302,552 | B1 * | 10/2001 | Ross et al. | 362/30 |
| 6,318,886 | B1 | 11/2001 | Stopa et al. | |
| 6,345,902 | B2 | 2/2002 | Ohkohdo | |
| 6,346,005 | B1 * | 2/2002 | Viklund et al. | 439/404 |
| 6,367,952 | B1 | 4/2002 | Gibboney, Jr. | |
| 6,371,637 | B1 | 4/2002 | Atchinson et al. | |
| 6,383,013 | B1 | 5/2002 | Ghesla et al. | |
| 6,394,626 | B1 | 5/2002 | McColloch | |
| 6,412,971 | B1 | 7/2002 | Wojnarowski et al. | |
| 6,450,664 | B1 | 9/2002 | Kelly | |
| 6,478,450 | B1 | 11/2002 | Grajcar | |
| 6,505,956 | B1 | 1/2003 | Priddy et al. | |
| 6,517,218 | B2 * | 2/2003 | Hochstein | 362/294 |
| 6,558,021 | B2 | 5/2003 | Wu et al. | |
| 6,566,824 | B2 | 5/2003 | Panagotacos et al. | |
| 6,578,986 | B2 | 6/2003 | Swaris et al. | |
| 6,582,100 | B1 | 6/2003 | Hochstein et al. | |
| 6,598,988 | B1 * | 7/2003 | Noll et al. | 362/26 |
| 6,609,813 | B1 | 8/2003 | Showers et al. | |
| 6,660,935 | B2 | 12/2003 | Southard et al. | |
| 6,663,257 | B2 * | 12/2003 | Galli | 362/119 |
| 6,712,486 | B1 | 3/2004 | Popovich et al. | |
| 6,787,999 | B2 * | 9/2004 | Stimac et al. | 315/51 |
| 6,932,495 | B2 | 8/2005 | Sloan | |
| 2003/0063463 | A1 * | 4/2003 | Sloan et al. | 362/238 |
| 2005/0030765 | A1 | 2/2005 | Southard et al. | |

FOREIGN PATENT DOCUMENTS

| | | | |
|---|---|---|---|
| DE | 198 29 774 | A1 | 1/2000 |
| EP | 0 331 224 | A2 | 9/1989 |
| EP | 0 632 511 | A2 | 1/1995 |
| EP | 1 002 696 | A2 | 5/2000 |
| GB | 1 490 978 | | 11/1977 |
| GB | 2 334 376 | | 5/1999 |
| JP | 63-5580 | | 1/1988 |
| JP | 02 172771 | | 7/1990 |
| WO | WO 99/39319 | | 8/1999 |
| WO | WO 00/22698 | | 4/2000 |
| WO | WO 00/31463 | | 6/2000 |
| WO | WO 00/36336 | | 6/2000 |
| WO | WO 02/097770 | A2 | 12/2002 |

OTHER PUBLICATIONS

U.S. Appl. No. 10/805,931.
U.S. Appl. No. 60/193,531, filed Mar. 31, 2000.
Internet Website http://www.chainlight.com "Chainlight".
Internet Website http://www.lektroninc.com/products/stencil Lecktron LED Lighting Technology, LED Channel Letter Stencil System.
High-Flux LED Blue, Green, and Cyan, Target/Preliminary Data, Mar. 16, 1999.
LumiLeds, Provisional Technical Data, Version 1.2 (Dec. 12, 2000) LumiLed Star.
LumiLeds, Provisional Technical Data, Version 3 D (Nov. 15, 2000) LumiLed Line.
LumiLeds, Technical Data, Luxeon™ Power Light Source.
Internet Website http://www.creativemag.com/cwo10100.html, Creative World Jan. 2000.
Internet Website http://www.smartlite.com/hiliter.html.
U.S. Appl. No. 10/805,931.
U.S. Appl. No. 10/820,838.
International Search Report dated Jul. 8, 2005 corresponding to International Application No. PCT/US2005/009870.
Written Opinion of International Searching Authority dated Jul. 8, 2005 corresponding to International Application No. PCT/US2005/009870.

* cited by examiner

FLEXIBLE HIGH-POWER LED LIGHTING SYSTEM

BACKGROUND

Light emitting diodes (LEDs) are employed as a basic lighting structure in a variety of forms, such as outdoor signage and decorative lighting. LED-based light strings have been used in channel letter systems, architectural border tube applications, under cabinet lighting applications, and for general illumination, many times to replace conventional neon or fluorescent lighting.

Known attempts to provide a lighting system that can replace neon or fluorescent lighting includes mechanically affixing an LED light source to a flexible electrical cord. Other known systems mount LEDs on printed circuit boards that are connected to one another by electrical jumpers. These known high-power LED products require mounting to conductive surfaces to dissipate the heat generated from the LED and are susceptible to mechanical and electrical failures due to external forces or poor installation techniques. These known systems also have limited flexibility and have limited lineal resolution. Furthermore, some of these systems are not user serviceable to replace individual LEDs or LED modules.

Accordingly, it is desirable to provide an LED light engine that overcomes the aforementioned shortcomings.

SUMMARY

An LED light engine includes a flexible electrical cable, a wire-socket assembly attached to the cable, and an LED module selectively attached to the wire-socket assembly. The wire-socket assembly includes at least two IDC terminals. Each IDC terminal displaces the insulating covering of the cable and contacts one of the electrical conductors. The LED module includes an LED that electrically connects to the IDC terminals when the LED module attaches to the wire-socket assembly.

An LED light engine includes a power delivery system, a mount attached to the cable, first and second terminals, and a LED module adapted to selectively attach to the mount. The power delivery system includes at least two electrical conductors. The terminals contact respective electrical conductors. The LED module includes an LED that electrically connects to the terminals when the LED module attaches to the mount.

A method for manufacturing an LED light engine includes the following steps: insulating electrical conductors to form a cable, inserting IDC connection terminals into the cable to contact the electrical conductors, securing a mounting assembly to the cable, and selectively attaching an LED module to the mounting assembly. The LED module includes an LED that electrically connects to the IDC terminals when the LED module attaches to the mounting assembly.

An LED light engine includes a flexible electrical cable, an LED module attached to the cable, and terminals inserted into the cable. The cable includes at least two electrical conductors and insulating covering surrounding the electrical conductors. The LED module includes an LED and a heat sink in thermal communication with the LED. The terminals contact the electrical conductors and electrically connect to the LED.

A channel letter includes a flexible electrical cable, a mount, terminals, an LED module and a channel letter housing. The flexible electrical cable includes at least two electrical conductors and insulating covering surrounding the electrical conductors. The mount attaches to the cable. First and second terminals displace the insulating covering of the cable to contact respective electrical conductors. The LED module can selectively attach to the mount and includes an LED. The cable is disposed in the channel letter housing.

DETAILED DESCRIPTION

Figure 1:
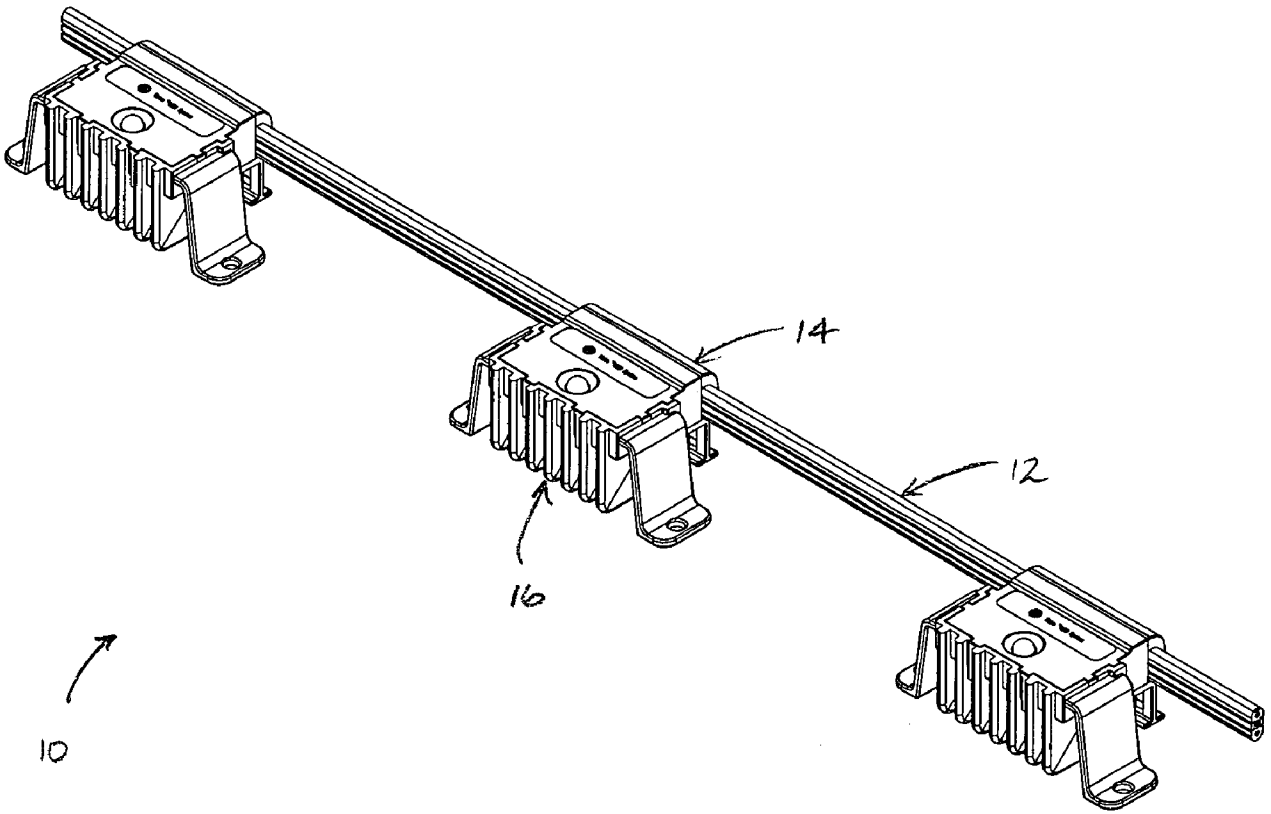
FIG. 1 is a perspective view of an LED light engine.
Figure 8:
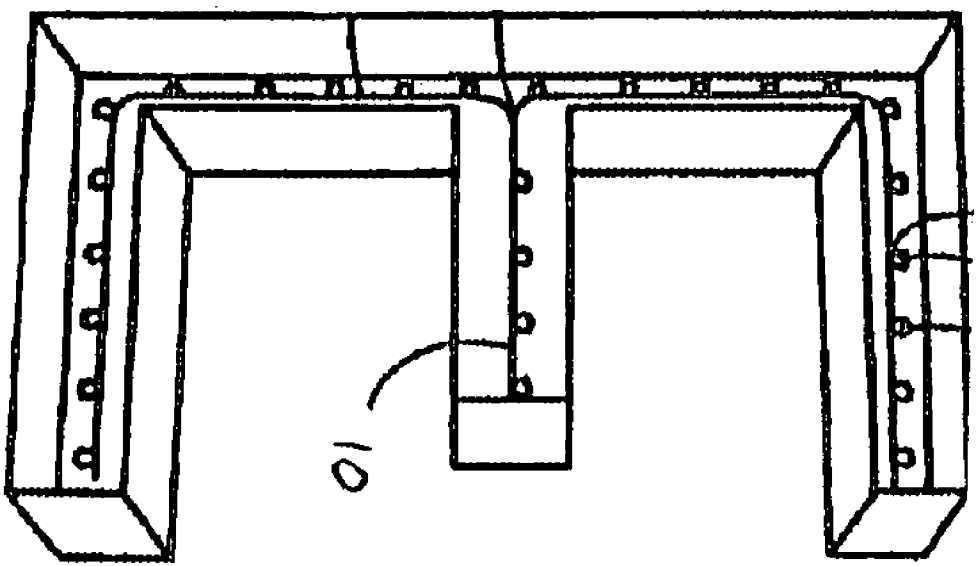
FIG. 8 illustrates the light engine of FIG. 1 disposed in a channel letter housing.

With reference to FIG. 1, a light emitting diode (LED) light engine 10 includes a flexible electrical cable 12, a wire-socket assembly 14 attached to the flexible electrical cable and an LED module 16 that selectively attaches to the wire-socket assembly. The light engine 10 can mount to a variety of different structures and can be used in a variety of different environments, some examples include channel letter and box sign illumination (FIG. 8), cove lighting, and under cabinet accent lighting to name a few.

Figure 2:
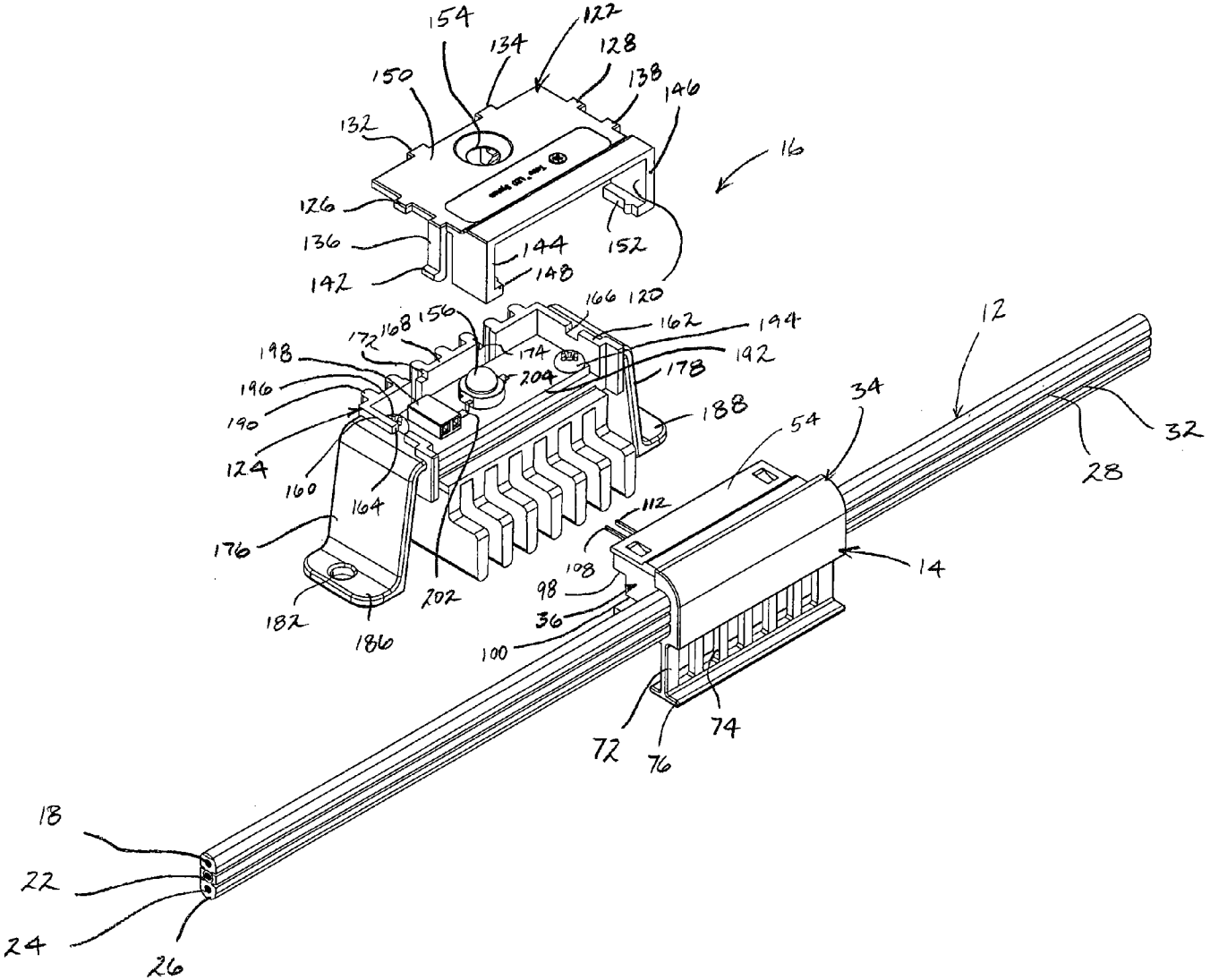
FIG. 2 is an exploded view of an LED module of the LED light engine of FIG. 1.

Referring to FIG. 2, the flexible electrical cable 12 includes a plurality of conductors 18, 22 and 24 surrounded by an insulating covering 26. Three conductors are depicted in the figures; however, the cable can include a several to many wires, where some of the wires may deliver power and some may deliver electronic signals or the like. Preferably, the conductors are 14 American wire gage (AWG) or 16 AWG; however, wire of other thickness can be used. With electricity running through the cable, the conductors can be referred to as a positive conductor 18, a negative conductor 24 and a series conductor 22. The conductors 18, 22, and 24 electrically connect to a power supply (not shown), which can include a low voltage output power supply, to provide voltage to the LED modules 16 for illumination. The conductors 18, 22, and 24 run parallel to a longitudinal axis of the cable 12 and are aligned with one another in a plane. Such an orientation allows the cable 12 to easily bend when placed on an edge that intersects the plane, e.g. the thinner edge of the cable in FIG. 2. The cable 12 also includes V-shaped grooves 28 and 32 formed in the insulating covering 26. The grooves 28 and 32 run longitudinally along the cable 12 parallel to the conductors 18, 22 and 24. The grooves 28 and 32 are situated between adjacent conductors 18, 22 and 24.

In alternative embodiments, power can be delivered to the LED modules 16 via other power supply systems. For example, the wire-socket assembly 14, which in this instance may be referred to as a mount or mounting assembly, can attach to a flexible circuit, e.g. copper traces on a flexible material, or a lead frame, e.g. an insulated lead frame formed from a stamped metal electrical bus. The flexible circuits and the lead frames can be connected to one another by wires, electrical jumpers or the like.

Figure 3:
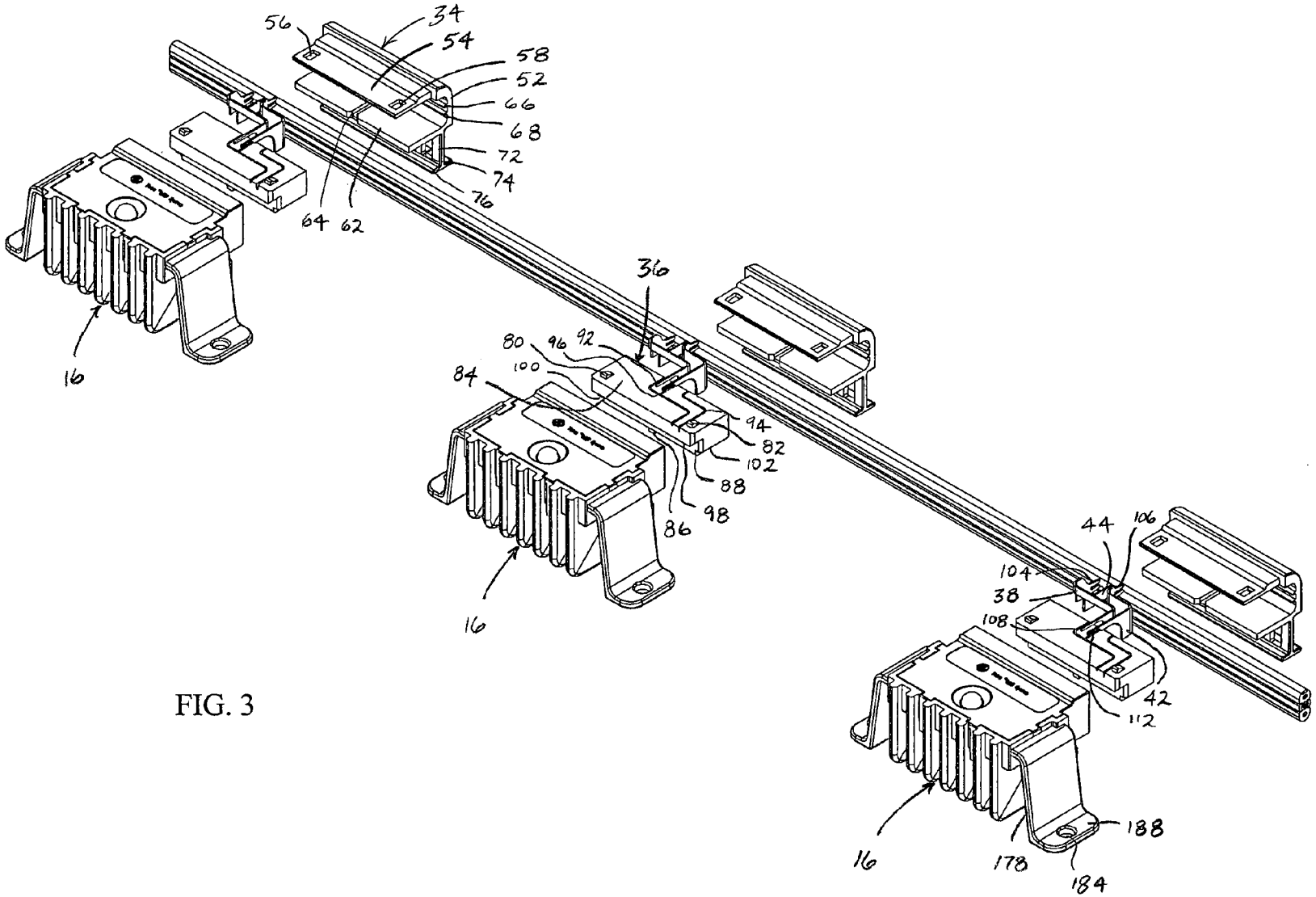
FIG. 3 is an exploded view of a wire-socket assembly of the LED light engine of FIG. 1.

As seen in FIG. 3, the wire-socket assembly 14 includes a cover 34, a base 36 and insulation displacement connection (IDC) terminals 38 and 42. The wire-socket assembly 14 allows LED module 16 to selectively attach to the electrical cable 12. Accordingly, the wire-socket assembly 14 can be referred to as a mount, a portion of a mount or a mounting assembly. In the embodiment depicted in the figures, the wire-socket assembly 14 plugs into the LED module 16, which allows for easy replacement of the LED module. In alternative embodiments, the LED module 16 can plug into the wire-socket assembly 14, or the LED module 16 can selectively attach to the wire-socket assembly 14 in other conventional manners. With these types of connections, replacement of one LED module 16 on the light engine 10 can be made without exposing the conductor wires 18, 22 and 24 of the electrical cable 12.

The cover 34 includes a generally backwards C-shaped portion 52 that fits around the electrical cable 12. An upper portion 54 of the cover 34 has a pair of openings 56 and 58 that are used when connecting the cover to the base 36. A lower portion 62 of the cover includes a slot 64. The lower portion 62 is parallel to and spaced from the upper portion 54 a distance equal to the height, measured in the plane of the conductors 18, 22 and 24, of the electrical cable 12. The cover 34 also includes longitudinal ridges 66 and 68 formed on an inner surface of the backwards C-shaped portion 52 between the upper portion 54 and the lower portion 62. The ridges 66 and 68 are received in the grooves 28 and 32 of the electrical cable 12. A pedestal 72 depends downwardly from the C-shaped portion 52. The pedestal 72 includes a plurality of elongated slots 74 spaced longitudinally along the pedestal. The pedestal 72 also includes a platform 76 below the slots 74. The platform 76 can rest on or against the surface to which the light engine 10 will be mounted.

The base 36 attaches to the cover 34 by fitting into the backwards C-shaped portion 52 between the upper portion 54 and the lower portion 62 sandwiching the cable 12 between the base and the cover. The base 36 includes two tabs 80 and 82 on an upper surface 84 that are received in the openings 56 and 58 in the upper portion 54 of the cover 34. The base 36 also includes a tongue 86 on a lower surface 88 that slides into the slot 64 in the lower portion 62 of the cover 34. Slots 92, 94 and 96 are formed in the upper surface 84 of the base 36. The slots 92 and 94 receive the IDC terminals 38 and 42. Slot 96 receives a conductor separator 44. When the cover 34 receives the base 36, the upper portion 54 covers the upper surface 84 of the base to cover the slots 92 and 94 and a majority of the IDC terminals 38 and 42. The base 36 further includes a lower longitudinal notch 98 formed along a face of the base adjacent the LED module 16 and lower lateral notches 100 and 102 formed on opposite lateral sides of the base. The notches 98, 100 and 102 facilitate the plug-in connection friction fit between the wire-socket assembly 14 and the LED module 16. In addition to the mechanical connection described between the wire-socket assembly 14 and the cable 12, the wire-socket assembly 14 can be formed with the cable 12 or affixed to the cable in other manners.

The IDC terminals 38 and 42 pierce the insulating material 26 that surrounds the conductors 18, 22 and 24 to provide an electrical connection. The IDC terminals 38 and 42 each include fork-shaped prongs 104 and 106 that are sharp enough to pierce the insulating covering 26 having tines spaced apart so that the prongs do not cut the conductors 18, 22 and 24, but rather receive the conductors between the tines. The IDC terminals 38 and 42 also include male terminal pins 108 and 112 that extend from the base toward the LED module 16 when the terminals are received in the slots 92 and 94 on the upper surface 84 of the base 36. The IDC terminals 38 and 42 are substantially S-shaped and the first prong 104 is spaced from the second prong 106 along the longitudinal axis of the electrical cable 12. The conductor separator 44 is spaced between the prongs 104 and 106 so that if the LED modules 16 are to be connected in parallel/series configuration, the series conductor wire 22 is cut between the prongs. Specific terminals 38 and 42 have been described; however, other terminals instead of IDC terminals can be used to provide the electrical connection between the conductors and the LED module. Furthermore, the alternative terminals can electrically attach to the wires and/or power supply system via solder, wire jumper, crimp on terminals, or other electrical-mechanical connections.

Figure 4:
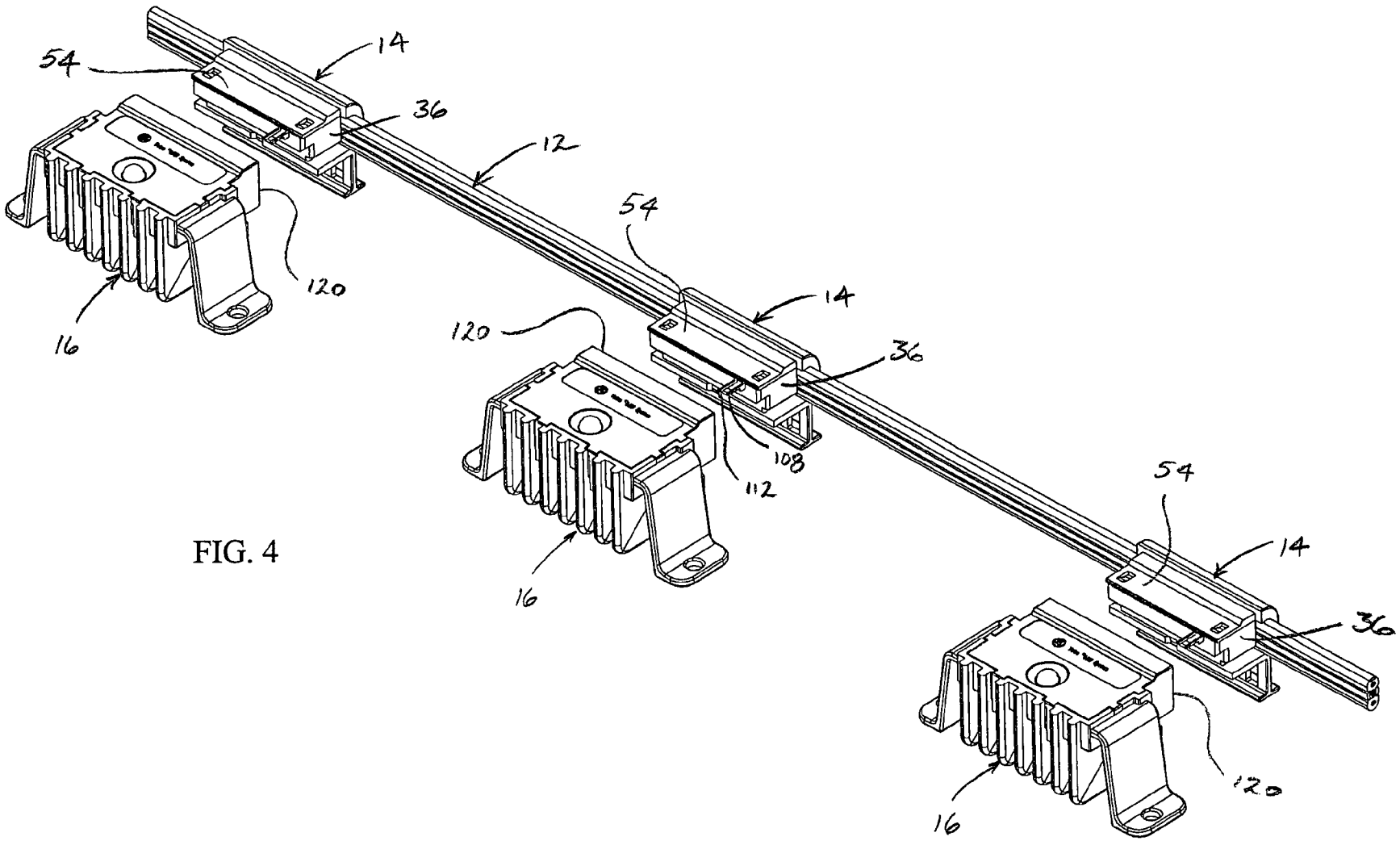
FIG. 4 is a view of the connection between the LED module and the wire-socket assembly of the LED light engine of FIG. 1.

With reference to FIG. 4, the wire-socket assembly 14 plugs into the LED module 16. The LED module 16 includes a mounting receptacle 120 into which the wire-socket assembly 14 fits. More specifically, the base 36 and the upper portion 54 of the cover 34 are received by receptacle 120. As mentioned above, in alternative embodiments the LED module 16 can plug into the wire-socket assembly 14, or the wire-socket assembly and the LED module can selectively attach to one another in other conventional manners.

With reference back to FIG. 2, the LED module 16 includes a cover 122 affixed to a base 124. The cover 122 includes two side tabs 126 and 128 on opposite sides of the cover and two rear tabs 132 and 134 on the rear of the cover. The cover 122 also includes two resilient clips 136 and 138 on opposite sides of the cover. The resilient clips 136 and 138 include knurls 142 (only one visible in FIG. 2). A pair of side walls 144 and 146 depend from opposite sides of the cover 122 in front (i.e., towards the wire-socket assembly 14) of both the respective side tabs 126 and 128 and the respective clips 136 and 138. Each side wall 144 and 146 includes a lower extension 148 and 152 that extend towards one another. The lower extensions 148 and 152 are spaced from an upper surface 150 of the cover 122 to define the mounting receptacle 120 of the LED module 16. The cover 122 also includes an opening 154 through which an LED 156 protrudes.

The cover 122 of the LED module 16 attaches to the base 124 of the LED module to cover the electrical connections leading to the LED 156. The base 124 includes side walls 160 and 162 that are opposite one another. Each side wall 160 and 162 includes a respective notch 164 and 166 that receives a respective side tab 126 and 128 on the cover 122. A rear wall 168 connects the side walls 160 and 162 and also includes notches 172 and 174 that receive rear tabs 132 and 134 of the cover 122. The side walls 160 and 162 make a right bend outward at the front of each side wall to accommodate the resilient clips 136 and 138. The clips 136 and 138 fit inside the side walls 160 and 162 and each knurl 142 catches on the bottom of each side wall to attach the cover 122 to the base 124.

Figure 7:
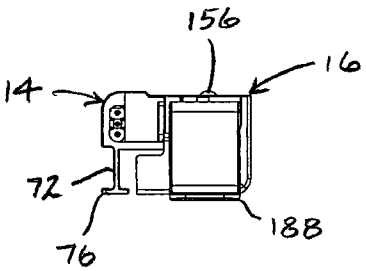
FIG. 7 an end elevation view of one LED module attached to one wire-socket assembly of the light engine of FIG. 1.
Figure 5:
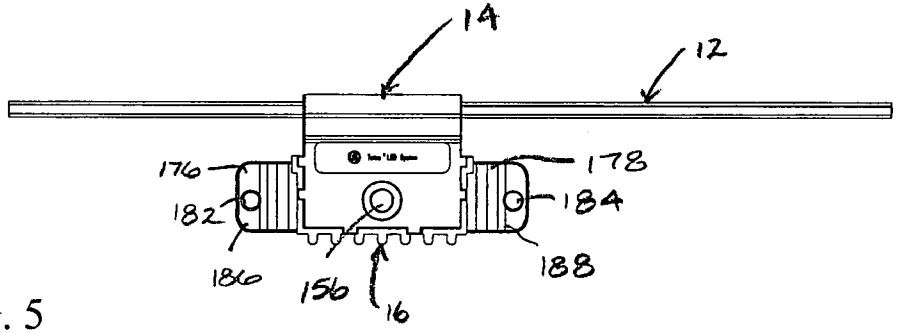
FIG. 5 is a plan view of one LED module attached to one wire-socket assembly of the light engine of FIG. 1.
Figure 6:
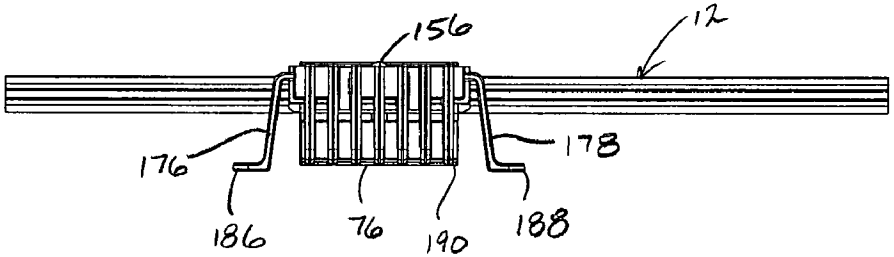
FIG. 6 is a side elevation view of one LED module attached to one wire-socket assembly of the LED light engine of FIG. 1.

Side connection tabs 176 and 178 extend from the side walls 160 and 162. The side connection tabs 176 and 178 include openings 182 and 184 (FIG. 3) in mounting surfaces 186 and 188 that can receive fasteners (not shown) to attach the LED module 16 to an associated surface, such as surfaces found in channel letter and box sign illumination, cove lighting, and cabinets. As seen in FIGS. 6 and 7, the mounting surfaces 186 and 188 are spaced from and below the platform 76. Referring to FIG. 1, the LED module 16 mounts in such a direction as compared to the electrical cable 12 to promote the greatest flexibility of the cable, i.e. the LED 156 faces a direction parallel to a plane that intersects the conductors 18, 22 and 24 of the cable 12.

Extending from the rear wall 168, a plurality of fins 190 can provide a heat sink for the LED 156. Fins are shown as the heat sink; however, the heat sink can also include pins or other structures to increase the surface area of the heat sink. The fins 190 extend rearward and downward from the rear wall 168. The fins 190 extend downward to almost the mounting surface 186 and 188 of each side connection tab 176 and 178, as seen in FIGS. 6 and 7, to maximize the surface area of the heat sink. As seen in FIG. 7, the fins 190 also extend towards the front, i.e. towards the cable 12, away from the upper portion of the base 124, again to maximize the surface area. With specific reference to FIG. 6, the fins 190 are aligned with the slots 74 in the pedestal 72 of the wire-socket assembly 14 so that air can flow through the slots 74 and between the fins 190 to cool the LED 156.

The LED 156 mounts to a support 192 that is received in the base 124 of the LED module 16. Preferably, the support 192 includes a thermally conductive material, e.g. thermal tape, a thermal pad, thermal grease or a smooth finish to allow heat generated by the LED 156 to travel towards the fins 190 where the heat can dissipate. The support 192 is affixed in the base 124 by fasteners 194 and 196; however, the support can affix to the base 124 in other conventional manners.

An electrical receptacle 198 mounts on the support 192 and receives male terminal pins 108 and 112 of the terminals 38 and 42 emanating from the wire-socket assembly 14. The electrical receptacle 198 electrically connects to leads 202 and 204 of the LED 156 via circuitry (not shown). The circuitry can be printed on the support 192, or wires can be provided to connect the receptacle to the leads 202 and 204. The circuitry can include voltage management circuitry.

In an alternative embodiment, an electrical receptacle similar to electrical receptacle 198 can mount to the wire-socket assembly 14. This electrical receptacle on the wire-socket assembly can receive male inserts that are electrically connected to the LED 156. Alternatively, selective electrical connection between the conductors 18, 22 and 24 and the LED 156 can be achieved in other conventional manners, including solder, wire jumper, crimp-on terminals, or other electromechanical connections.

As seen in FIG. 4, the LED module 16 receives the wire-socket assembly 14 to mount the LED module to the cable 12. Such a connection allows removal of the LED module 16 from the cable 12 without the holes formed by the IDC terminals 38 and 42 being exposed. With reference to FIG. 2, the base 36 and the upper portion 54 of the cover 34 are received between the lower extensions 148 and 152 and the upper surface 150 of the cover 122 such that the extensions 148 and 152 fit into the lower lateral notches 100 and 102 of the base 36 of the wire-socket assembly. The lower longitudinal notch 98 of the base 36 rest against the support 192 for the LED 156. The male terminal pins 108 and 112 are received by the electrical receptacle 198 to provide the electrical connection between the LED 156 and the conductors 18, 22 and 24. Accordingly, a friction fit exists between the LED module 16 and the wire-socket or mounting assembly 14 such that the LED module can be selectively removed from the cable 12 and the holes formed by the IDC terminals are not exposed. The plug-in connection between the LED module 16 and the mounting assembly 14 facilitates easy installation and LED replacement. Also, the heat sink provided on the LED module 16 allows the light engine 10 to dissipate heat without requiring the light engine to mount to a heat conductive surface.

The LED light engine has been described with reference to the preferred embodiments. Obviously, modifications and alterations will occur to others upon reading and understanding the preceding detailed description. It is intended that the invention can be construed as including all such modifications and alterations in so far as they come within the scope of the appended claims or the equivalents thereof.

The invention claimed is:

1. A light emitting diode (LED) light engine comprising:

a flexible electrical cable including at least three electrical conductors residing in substantially the same plane and insulating covering surrounding the electrical conductors;

a plurality of wire-socket assemblies attached to the cable, each wire socket assembly including at least two insulation displacement connection (IDC) terminals, wherein each IDC terminal displaces the insulating covering of the cable and contacts one of the electrical conductors; and a plurality of LED modules each selectively attached to a respective wire-socket assembly, each LED module including an LED, a heat sink in thermal communication with the LED, and an assembly receptacle, the LED electrically connects to the IDC terminals when the LED module attaches to the respective wire-socket assembly and the assembly receptacle receives the respective wire-socket assembly.

2. The light engine of claim 1, wherein at least one of the wire-socket assemblies includes an electrical receptacle.

3. The light engine of claim 1, wherein at least one of the LED modules includes an electrical receptacle electrically connected to the LED.

4. A channel letter comprising:

a channel letter housing; and the light engine of claim 1 disposed in the channel letter housing.

5. The light engine of claim 1, wherein at least one of the wire-socket assemblies includes a base and the IDC terminals reside in the base such that each IDC terminal includes a first portion extending from the base toward the cable and a second portion extending from the base toward at least one of the LED modules.

6. The light engine of claim 5, wherein the at least one wire-socket assembly includes a cover at least substantially covering the IDC terminals between the first portion and the second portion.

7. The light engine of claim 5, wherein the at least one LED module includes an electrical receptacle to receive the second portion of each IDC terminal.

8. A light emitting diode (LED) light engine comprising:

a flexible electrical cable having at least two electrical conductors and insulating covering surrounding the electrical conductors;

an LED module attached to the cable, the LED module including an LED, a thermally conductive support, circuitry disposed on a first surface of the thermally conductive support, an electrical connector disposed on the first surface and in electrical communication with the circuitry and a heat sink in thermal communication with the LED via the thermally conductive support, the LED being in electrical communication with the circuitry; and an IDC terminal inserted into the cable and into the connector, the terminal in contact with the electrical conductors and electrically connected to the LED via the electrical connector.

9. A channel letter comprising:

a channel letter housing; and the light engine of claim 8 disposed in the channel letter housing.

10. The light engine of claim 8, wherein the electrical connector comprises a male insert electrically connected to the LED.

11. The light engine of claim 8, wherein the electrical connector comprises an electrical receptacle.

12. The light engine of claim 11, wherein the terminals include male terminal pins that are received in the electrical receptacle.

13. A light emitting diode (LED) light engine comprising:

a flexible electrical cable including at least two electrical conductors and insulating covering surrounding the electrical conductors;

a first mounting assembly attached to the cable;

a first LED module attached to the first mounting assembly and including a first LED and a first heat sink in thermal communication with the first LED;

a first insulation displacement connection (IDC) terminal disposed in the first mounting assembly, wherein the first IDC terminal is in electrical communication with the first LED and at least one of the electrical conductors; and a second LED module attached to the cable and in electrical communication with at least one of the electrical conductors, the second LED module being spaced from the first LED module along the cable and including a second LED and a second heat sink in thermal communication with the second LED.

14. The light engine of claim 13, wherein the first heat sink is adapted to dissipate enough heat from the first module such that the first module can mount to a heat insulative surface.

15. The light engine of claim 13, wherein the first mounting assembly comprises a first component and a second component, the cable being sandwiched between the first component and the second component.

16. The light engine of claim 13, wherein the first LED module receives the first mounting assembly.

17. A channel letter comprising:

a channel letter housing; and the light engine of claim 13 disposed in the channel letter housing.

18. A method for manufacturing an LED string light engine comprising:

providing an insulated flexible electrical cable including electrical conductors;

inserting at least one IDC terminal into the cable to contact at least one of the electrical conductors;

inserting the at least one IDC terminal into a connector mounted on a first surface of a support to electrically connect an LED mounted on the first surface of the support to the electrical conductors of the cable via the at least one IDC terminal and the connector;

contacting the support with a heat sink such that heat from the LED is drawn through the support into the heat sink; and connecting the heat sink to the cable such that the heat sink is connected to and movable with the cable so that the string light engine can mount to a variety of different structures.

19. The method of claim 18, further comprising:

inserting the at least one IDC terminal into a wire-socket assembly; and connecting the wire-socket assembly to the cable.

20. A string light engine comprising:

a flexible electrical cable including at least three electrical conductors and insulating covering surrounding the electrical conductors;

a plurality of wire-socket assemblies attached to the cable, each wire socket assembly including at least two insulation displacement connection (IDC) terminals and a conductor separator for electrically separating at least one of the electrical conductors, wherein each IDC terminal displaces the insulating covering of the cable and contacts one of the electrical conductors; and a plurality of LED modules each attached to the cable via a respective wire-socket assembly, at least one LED module including a thermally conductive support, circuitry disposed on a first surface of the support, at least one LED disposed on the first surface of the support, and a heat sink in thermal communication with the support.

21. A channel letter comprising:

a channel letter housing; and the light engine of claim 20 disposed in the channel letter housing.

* * * * *